United States Patent [19]

Chandley

[11] 4,112,997

[45] Sep. 12, 1978

[54] METAL CASTING

[75] Inventor: George D. Chandley, Amherst, N.H.

[73] Assignee: Hitchiner Manufacturing Co., Inc., Milford, N.H.

[21] Appl. No.: 772,817

[22] Filed: Feb. 28, 1977

[51] Int. Cl.[2] ..... B22D 17/14; B22C 9/08; B22C 9/22

[52] U.S. Cl. ..... 164/119; 164/130; 164/133; 164/350; 164/361

[58] Field of Search ..... 164/6, 7, 77, 78, 358, 164/359, 360, 361, 362, 363, 255, 62, 133, 134, 35, 36, 244, 249, 350, 51, 119, 130

[56] References Cited

U.S. PATENT DOCUMENTS

| | | | |
|---|---|---|---|
| 1,030,066 | 6/1912 | Erlandson | 164/358 |
| 1,049,877 | 1/1913 | Lange | 164/358 |
| 1,664,452 | 4/1928 | Daniels | 164/358 |
| 2,109,530 | 3/1938 | Grundstrom | 164/358 |
| 2,518,040 | 8/1950 | Mann | 164/34 X |
| 3,508,601 | 4/1970 | McArdle | 164/358 |
| 3,628,598 | 12/1971 | MacNeill | 164/133 X |
| 3,705,615 | 12/1972 | Watts | 164/65 X |
| 3,900,064 | 8/1975 | Chandley | 164/136 X |

FOREIGN PATENT DOCUMENTS

| | | | |
|---|---|---|---|
| 1,280,495 | 10/1968 | Fed. Rep. of Germany | 164/358 |

*Primary Examiner*—Francis S. Husar
*Assistant Examiner*—John S. Brown

[57] ABSTRACT

Gas permeable shell molds and methods of using them for vacuum/inert gas casting of metal are disclosed. The single or multiple cavity gas permeable shell mold described has a riser passage with an open lower end and one or more mold cavities connected to the riser passage by gate passages each having a novel stabilizing screen member with a multiplicity of openings therein extending across it. The screen is preferably in a slanted plane with the bottom portion thereof nearer to the mold cavity. The stabilizing screen makes possible the draining of molten metal from the riser passage and from the portion of the gate passages between the stabilizing screen and the riser passage before complete solidification of the molten metal in the mold cavities, by stabilizing molten metal in the mold cavities and in the portion of the gate passages between the stabilizing screen and mold cavity, during and subsequent to the drainage of molten metal from the riser passage and from the portion of the gate passages between the stabilizing screen and the riser passage.

3 Claims, 6 Drawing Figures

FIG 1
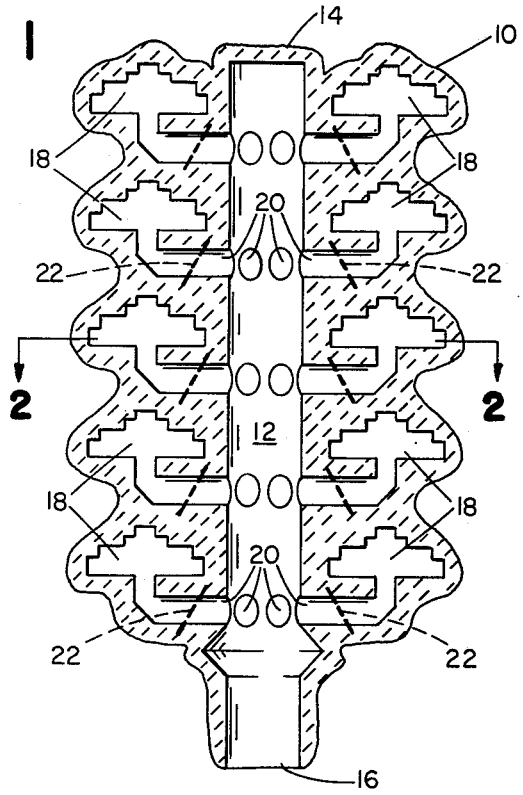
FIG 2
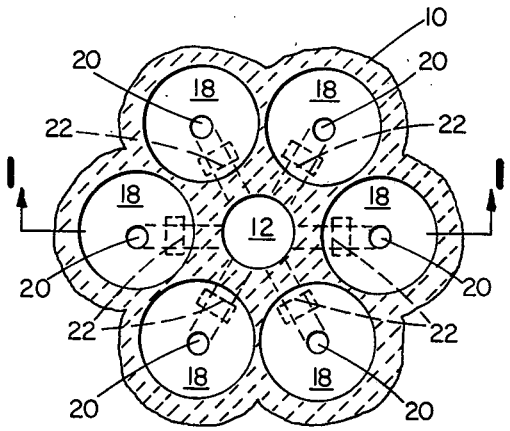
FIG 3
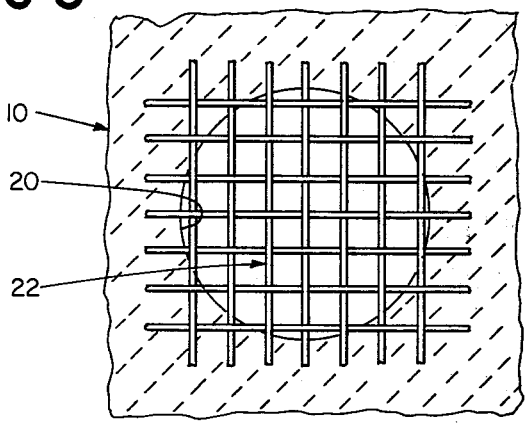
FIG 4
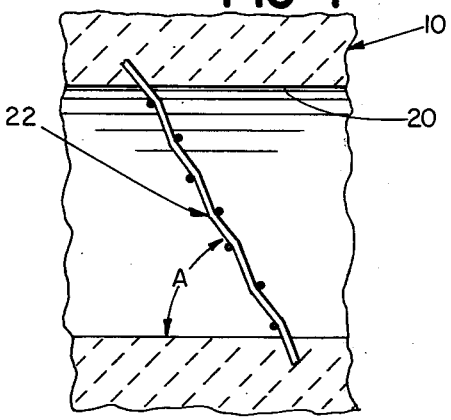
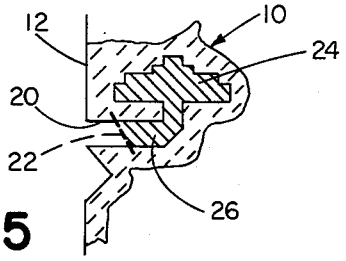
FIG 5
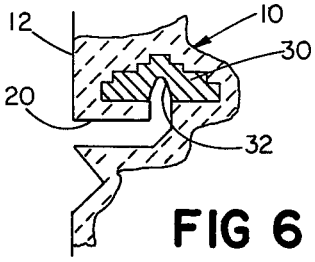
FIG 6

METAL CASTING

This invention relates to gas permeable shell molds and methods of using them for casting metal.

In U.S. Pat. Nos. 3,863,706 and 3,900,064 is disclosed apparatus, as well as multiple cavity, gas permeable, shell molds and methods for the high production casting of a plurality of discrete, unconnected parts in a single, multiple cavity mold.

Although the molds and methods of those patents are highly successful in the commercial casting of relatively small parts, that is, those having a thickness of no more than about 3/4 inch, they have proved to be uneconomical for thicker parts.

Accordingly, it is a major object of the present invention to provide improved molds and methods capable of the economical casting of relatively thick parts.

It is another object of the invention to provide for the filtering out of impurities in the molten metal just prior to its entering the mold cavity.

These objects are accomplished, according to the molds and methods of the present invention, by providing a gas permeable shell mold having a riser passage with an open lower end and one or more mold cavities connected to the riser passage by a gate passage having a novel perforate stabilizing member, i.e. screen means, extending thereacross, preferably of heat insulating material, such as ceramic. Preferably, the stabilizing screen member is positioned in a slanted plane with the bottom portion thereof nearer to the mold cavity, at an angle of about 45° to 60° to the horizontal.

According to the methods of the invention, the novel stabilizing screen means makes possible the draining of molten metal from the riser passage and from the portion of the gate passage between the stabilizing screen means and the riser passage, before complete solidification of the molten metal in the mold cavity, by stabilizing molten metal in the mold cavity and in the portion of the gate passage between the stabilizing screen means and mold cavity, during and subsequent to the drainage of molten metal from the riser passage and from the portion of the gate passage between the stabilizing screen means and the riser passage.

For the purpose of more fully explaining the above and further objects and features of the invention, reference is now made to the following detailed description of preferred embodiments thereof, together with the accompanying drawings, wherein:

FIGS. 1 and 2 are, respectively, side and top sectional views of the gas permeable mold of the invention;

FIGS. 3 and 4 are, respectively, end and side detail views of the stabilizing screen in the gate passages of the mold of FIGS. 1 and 2;

FIG. 5 is a side view of a mold cavity of the mold of FIGS. 1 and 2 filled with solidified metal after drainage of molten metal from the riser passage according to the methods of the invention; and FIG. 6 is a side view of a mold cavity of the prior art illustrating the result of drainage from the riser passage without the use of the stabilizing screen of the invention.

The molds and methods of the present invention may be used in conjunction with the apparatus and methods disclosed in U.S. Pat. Nos. 3,863,706 and 3,900,064, which are incorporated by reference herein.

Referring to the drawings, the multiple cavity, gas permeable mold shown therein is of the precision, refractory, gas permeable. shell type manufactured by the "lost wax" technique and is generally well known and widely used in the casting of a variety of ferrous and non-ferrous metals and alloys, such as steel, aluminum and nickel-chromium alloys, for example. The shell mold, generally designated 10, has a central, vertical riser passage 12 with a closed upper end 14 and an open lower end 16. A plurality of mold cavities 18 are clustered about riser passage 12 and connected to it by gate passages 20, the mold cavities 18 preferably being positioned above the ends and generally centrally of their connecting gate passages 20.

According to the present invention, each of the gate passages 20 is provided with a novel stabilizing perforate screen member 22 embedded in the wall of mold 10 around the periphery of a generally horizontal gate passage 20 and extending transversely across the generally horizontal gate passage, preferably in a slanted plane with its bottom portion nearer to the mold cavity and at an angle A of about 45° to 60° to the horizontal, for stabilizing molten metal in the portion of gate passage 20 between stabilizing screen 22 and mold cavity 18, during and subsequent to drainage of molten metal from riser passage 12 and from the portion of gate passage 20 between stabilizing screen 22 and riser passage 12, all as hereinafter more fully explained. It also functions to filter impurities from the molten metal when the mold cavities 18 are being filled.

Stabilizing screen 22 can be of any suitable material, metal or ceramic, which will not react with the molten metal being cast, and either of woven or perforate sheet material having a multiplicity of openings therein, the term "screen means" as used herein including all such types of material. However, it is preferred that the screens be made of woven refractory ceramic fibers, such as conventional fiberglass for low melting alloys of aluminum and Dow AB-312 for high melting alloys of nickel, iron or cobalt, The fibers may be about 0.005–0.001 inch diameter and about 30 of them may be twisted to form a yarn which may be of about 0.020 inch diameter. These yarns are then woven into a screen, with a relatively small mesh size, providing an open area of about 10 to 40 percent, preferably about 20 percent, of the cross sectional area of gate passage 20. Screens of ceramic materials are preferred, in part, because they are heat insulating and so reduce heat flow from the mass of molten metal in riser passage 12 into the molten metal in mold cavity 18, causing it to solidify sooner than would otherwise be the case.

The molds of the present invention may be readily manufactured by incorporating the stabilizing screens 22 into the wax or other patterns on which the ceramic molds are built, with the screens extending transversely across and outwardly beyond the gate passage portions thereof so that they will be positioned within the walls of the finished mold 10 and extend transversely across the gate passages 20 thereof.

The stabilizing screen of the invention may also be utilized with other types of disposable, gas permeable molds, such as the well-known sand and resin shell molds.

The multiple cavity mold 10 with the novel stabilizing screens 22 of the present invention may be used with the apparatus disclosed in said patents and generally according to the methods thereof. That is, by providing a crucible for holding molten metal, lowering the open lower end 16 of mold 10 beneath the surface of molten metal in the crucible and providing a differential pressure to the mold, causing the molten metal to fill riser passage 12 and mold cavities 18 through gate passages 20. During filling, stabilizing screens 22 function to filter out impurities from the molten metal before it enters mold cavity 18. Their position in a slanted plane, with the bottom portion of a screen 22 nearer to the mold cavity 18, produces an upward flow of molten metal through them during filling, with such flow beginning at the bottom of a gate passage 20 and progressively moving upwardly along the screen 22 as the gate passage 20 fills. This action reduces turbulence in the molten metal and so improves the quality of the cast parts.

According to the methods of the present invention, the steps subsequent to filling differ somewhat from the methods of said patents by reason of the presence of stabilizing screens 22. More specifically, the presence of the stabilizing screens 22 makes it unnecessary to completely solidify the molten metal in mold cavities 18 before releasing the vacuum to cause its drainage from riser passage 12 into the crucible, so that, unlike the methods of said patents, all that is required by the present invention before releasing the vacuum is at least in part solidifying the molten metal as a skin around the periphery of the mold cavities 18 and as a skin around the periphery of the gate passages 20, in the portions thereof between the mold cavities 18 and screens 22. This is an important feature, not only because of the time saved in the molding cycle, but also because it permits the drainage of molten metal to begin before there has been any solidification thereof in the riser passage, so that the multiple parts will not be connected together by a solidified riser.

Thus, in the present invention, the stabilizing screens 22 make possible the draining of the molten metal from riser passage 12 and from the portion of gate passages 20 between the stabilizing screens 22 and riser passage 12, before its complete solidification in mold cavities 18. This occurs because of the unique action of stabilizing screens 22 in stabilizing the molten metal in the mold cavities and in the portion of gate passages 20 between the stabilizing screens 22 and mold cavities 18, during and subsequent to the drainage of molten metal from the riser passage 12 and from the portion of the gate passages between the stabilizing screens 22 and the riser passage 12. More specifically, once a skin of solidified metal is formed on the periphery of the portion of gate passages 20 between the stabilizing screens 22 and mold cavities 18, the vacuum outside of mold 10 may be released. In the prior art, without using the stabilizing screen of the present invention, metal in the gate passage and mold cavity which was still liquid, upon release of the vacuum, would flow back by gravity into the riser passage, forming a defective casting 30 with an unacceptable recess 32 in its lower surface, as shown in FIG. 6.

The unique result of providing the liquid film stabilizing screen 22 of the invention in the gate passage 20 is shown in FIG. 5. The liquid metal in the center of the gate passage 20 between screen 22 and mold cavity 18 is stabilized; that and the skin of solid metal on the periphery of mold cavity 18 and gate passage 20 maintains the molten metal in mold cavity 18. This causes the molten metal to stay in the cavity 18 and in that part of gate passage 20 between the stabilizing screen 22 and the mold cavity 18, while the molten metal in the portion of gate passage 20 between stabilizing screen 22 and the riser passage 12 flows back into the riser passage 12 and thence into the crucible.

Thus, after the completion of the drainage step and the complete solidification of the molten metal in mold cavity 18, the molds and methods of the present invention provide a plurality of separated parts 24 having gates 26 which extend through gate passages 20 from the mold cavities 18 to the stabilizing screens 22.

The molds and methods of the present invention have proved to be particularly useful in the casting of parts, for example, tubocharger wheels with thicknesses up to 1½ inches, cast of nickel base alloys such as INCO-713 and GMR-235 which require bottom filling of the mold cavities. With such a requirement, the mold cavities 18 must be located above and preferably symmetrically with respect to the connecting ends of their gate passages 20. Without the use of the molds and methods of the present invention, such positioning is particularly prone to produce defective parts, as shown in FIG. 6 and discussed above. On the other hand, the molds and methods of the present invention, including the slanted positioning of stabilizing screen 22 in the gate passage 20 for improved filtering of impurities and reduced turbulence, have made the production of such parts possible on an economical basis because of their substantial reduction of mold cycle time.

I claim:

1. A method of casting a plurality of parts in a multiple cavity, gas permeable, shell mold, comprising the steps of providing a mold with a central vertical riser passage having an open lower end and having a plurality of mold cavities connected to said riser passage by gate passages having screen means extending thereacross, said screen means extending across said gate passages in a slanted plane with the bottom portion thereof nearer to said mold cavities and at an angle of about 45° to 60° to the horizontal lowering the open lower end of said mold beneath the surface of molten metal, causing molten metal to fill said riser passage and said mold cavities through said gate passages and said stabilizing screen means therein and to filter out impurities, while gas in said cavities escapes through their walls at least in part solidifying said molten metal around the periphery of said mold cavities and the portion of said gate passages between said stabilizing screen means and said mold cavities while maintaining said molten metal as a liquid in said riser passage and in the portion of said gate passages between said stabilizing screen means and said riser passage and draining molten metal from said riser passage and from the portion of said gate passages between said stabilizing screen means and said riser passage before complete solidification of said molten metal in said mold cavities, said stabilizing screen means stabilizing molten metal in said mold cavities and in the portion of said gate passages between said stabilizing screen means and said mold cavities during and subsequent to said drainage of molten metal from said riser passage and from the portion of said gate passages between said stabilizing screen means and said riser passage.

2. A method as claimed in claim 1, wherein said mold cavities are positioned above their connecting gate passages.

3. A method of casting a plurality of parts in a multiple cavity, gas permeable, shell mold, comprising the steps of providing a mold with a central vertical riser passage having an open lower end and having a plurality of mold cavities with gas permeable walls connected to said riser passage by gate passages having screen means extending thereacross, said screen means being heat insulating and extending across said gate passages in a slanted plane with the bottom portion thereof nearer to said mold cavities and at an angle of about 45° to 60° to the horizontal, and said mold cavities being positioned above their connecting gate passages lowering the open lower end of said mold beneath the surface of molten metal, providing a differential pressure to said cavities through said walls of said cavities, causing molten metal to fill said riser passage and said mold cavities through said gate passages and said stabilizing screen means therein and to filter out impurities, while gas in said mold cavities escapes through their walls and maintaining said differential pressure, while at least in part solidifying said molten metal around the periphery of said mold cavities and the portion of said gate passages between said stabilizing screen means and said mold cavities, while maintaining said molten metal as a liquid in said riser passage and in the portion of said gate passages between said stabilizing screen means and said riser passage, and releasing said differential pressure, causing draining of molten metal from said riser passage and from the portion of said gate passages between said stabilizing screen means and said riser passage, before complete solidification of said molten metal in said mold cavities, said stabilizing screen means stabilizing molten metal in said mold cavities and in the portion of said gate passages between said stabilizing screen means and said mold cavities during and subsequent to said drainage of molten metal from said riser passage and from the portion of said gate passages between said stabilizing screen means and said riser passage.

* * * * *